US006027306A

United States Patent [19]

Bunker

[11] Patent Number: 6,027,306

[45] Date of Patent: Feb. 22, 2000

[54] TURBINE BLADE TIP FLOW DISCOURAGERS

[75] Inventor: Ronald Scott Bunker, Niskayuna, N.Y.

[73] Assignee: General Electric Company, Schenectady, N.Y.

[21] Appl. No.: 08/880,960

[22] Filed: Jun. 23, 1997

[51] Int. Cl.[7] ..... F01D 11/02

[52] U.S. Cl. ..... 415/173.5; 415/115; 415/173.1; 416/97 R; 416/224; 416/92

[58] Field of Search ..... 415/115, 116, 415/173.1, 173.4, 173.5, 173.6; 416/92, 96 R, 96 A, 97 R, 224

[56] References Cited

U.S. PATENT DOCUMENTS

| | | | |
|---|---|---|---|
| 3,575,523 | 4/1971 | Gross, Jr. | 415/173.1 |
| 4,130,373 | 12/1978 | Giles | 415/116 |
| 4,161,318 | 7/1979 | Stuart et al. | 415/173.6 |
| 4,390,320 | 6/1983 | Eiswerth | 416/97 R |
| 4,753,575 | 6/1988 | Levengood et al. . | |
| 4,893,987 | 1/1990 | Lee et al. | 416/92 |
| 5,261,789 | 11/1993 | Butts et al. . | |
| 5,403,158 | 4/1995 | Auxier . | |
| 5,476,364 | 12/1995 | Kildea . | |
| 5,482,435 | 1/1996 | Dorris et al. . | |

FOREIGN PATENT DOCUMENTS

| | | | |
|---|---|---|---|
| 57-52603 | 3/1982 | Japan | 415/173.1 |
| 2155558 | 9/1985 | United Kingdom | 415/173.1 |

OTHER PUBLICATIONS

Y.W. Kim et al., "A Summary of the Cooled Turbine Blade Tip Heat Transfer and Film Effectiveness Investigations Performed by Dr. D.E. Metzger", Presented at the International Gas Turbine and Aeroengine Congress and Exposition, The Hague, Netherlands, Jun. 13–16, 1994.

D.E. Metzger et al., "Cavity Heat Transfer on a Transverse Grooved Wall in a Narrow Flow Channel", Journal of Heat Transfer, vol. 111/73, Feb. 1989.

*Primary Examiner*—Christopher Verdier

*Attorney, Agent, or Firm*—Patrick K. Patnode; Marvin Snyder

[57] ABSTRACT

A turbine assembly comprises a plurality of rotating blade portions in a spaced relation with a stationery shroud. The rotating blade portions comprise a root section, a tip portion and an airfoil. The tip portion has a pressure side wall and a suction side wall. A number of flow discouragers are disposed on the blade tip portion. In one embodiment, the flow discouragers extend circumferentially from the pressure side wall to the suction side wall so as to be aligned generally parallel to the direction of rotation. In an alternative embodiment, the flow discouragers extend circumferentially from the pressure side wall to the suction side wall so as to be aligned at an angle in the range between about 0° to about 60° with respect to a reference axis aligned generally parallel to the direction of rotation. The flow discouragers increase the flow resistance and thus reduce the flow of hot gas flow leakage for a given pressure differential across the blade tip portion so as to improve overall turbine efficiency.

15 Claims, 3 Drawing Sheets

TURBINE BLADE TIP FLOW DISCOURAGERS

This invention was made with government support under government contract number DEFC2195MC31176, awarded by the Department of Energy (DOE). The government has certain rights to this invention.

BACKGROUND OF THE INVENTION

This application relates to turbine blades and in particular relates to improved turbine blade tip clearance characteristics.

Turbine engines include a compressor for compressing air that is mixed with fuel and ignited in a combustor for generating combustion gases. The combustion gases flow to a turbine such that thermal energy produced within the combustor is converted into mechanical energy within the turbine by impinging the hot combustion gases onto one, or alternatively, a series of bladed rotor assemblies.

The performance and efficiency of turbine engines are critically affected by the clearances that exist between the rotating and stationary components within the turbine. As the clearances increase between the bladed rotor assemblies and the stationary assemblies, such as shrouds, the efficiency of the turbine decreases.

Accordingly, it is desirable for a turbine designer to maintain the clearances, herein referred to as "clearance gaps", between the bladed rotor assemblies and the shroud at a minimum without interfering with the rotation of the rotor assembly or affecting the structural integrity of the rotor or shroud. Even with sophisticated clearance control methods, however, clearance gaps cannot be completely eliminated.

The clearance gaps between the tip of the rotor blades and the adjacent stationary shrouds provide a narrow flow passage between the pressure and suction sides of a blade, resulting in hot gas flow leakage that is detrimental to the blade aerodynamic performance. Although the resulting leakage flow is undesirable, the clearance gaps must accommodate for the overall growth of the blade during operation. The overall growth of the blade is a product of several growth components including thermal expansion of the rotor, which expansion results because the rotor is typically more difficult to cool than the shroud. This cooling difficulty arises because the rotor blade extends over a relatively large radial distance and involves the thermal expansion of many sections, whereas the shroud is a much more compact component.

As beforementioned, the primary detrimental effect of the tip leakage flow is on the blade aerodynamic performance but a second important and less well understood effect concerns the convection heat transfer associated with the leakage flow. Surface area at the blade tip in contact with the hot working gas represents an additional thermal loading on the blade which, together with heat transfer to the suction and pressure side surface area, must be removed by the blade internal cooling flows. The additional thermal loading imposes a thermodynamic penalty on engine performance and degrades overall turbine performance.

The resultant thermal loading at the blade tip can be very significant and detrimental to the tip durability, especially the blade tip region near the trailing edge, which region can be difficult to cool adequately with blade internal cooling flows. As a result, blade tips have traditionally been one of the turbine areas most susceptible to structural damage. Structural damage to the blade tips can have a severe effect on turbine performance. Loss of material from the tip increases the clearance gap, increases the leakage flow and heat transfer across the tip, and in general exacerbates all of the above problems.

Numerous conventional blade tip designs exist for maintaining the proper pressure and suction side flow surfaces of the blade at the tip cap as well as providing minimum clearances with the stator shroud. Numerous cooling configurations also exist for cooling the blade tip caps for obtaining useful lives of the blades without undesirable erosion. Since cooling of the blade, including the blade tip, uses a portion of the compressed air from the gas turbine compressor, that air is unavailable for combustion in the combustor of the engine which decreases the overall efficiency of the turbine engine. Accordingly, the cooling of the blade including the blade tip should be accomplished with as little compressed air as possible to minimize the loss in turbine efficiency.

Therefore, it is apparent from the above that there exists a need in the art for improvements in turbine blade tip leakage flow characteristics.

SUMMARY OF THE INVENTION

A turbine assembly comprises a plurality of rotating blade portions in a spaced relation with a stationary shroud. The rotating blade portions comprise a root section, a tip portion and an airfoil. The root section is affixed to a rotor. The tip portion has a pressure side wall and a suction side wall. A number of flow discouragers are disposed on the blade tip portion. In one embodiment, the flow discouragers extend circumferentially from the pressure side wall to the suction side wall so as to be aligned generally parallel to the direction of rotation. In an alternative embodiment, the flow discouragers extend circumferentially from the pressure side wall to the suction side wall so as to be aligned at an angle in the range between about 0° to about 60° with respect to a reference axis aligned generally parallel to the direction of the blade rotation. The flow discouragers increase the flow resistance and thus reduce the flow of hot gas flow leakage for a given pressure differential across the blade tip portion so as to improve overall turbine efficiency.

DETAILED DESCRIPTION OF THE INVENTION

Figure 1:
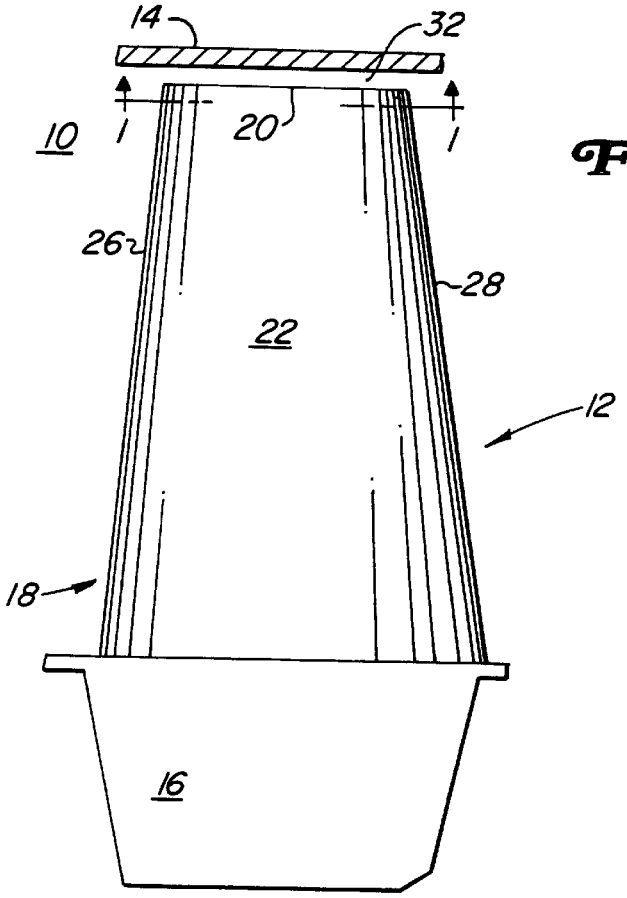
FIG. 1 is a schematic elevational view of a representative turbine blade.

A turbine assembly 10 comprises a plurality of rotor blade portions 12 and an outer shroud 14 concentrically disposed about rotor blade portion 12, as shown in FIG. 1. Rotor blade portion 12 comprises an inner root portion 16, an airfoil 18 and an outer tip portion 20. Although the present invention is described herein in connection with turbine assembly 10, the present invention is not limited to practice in turbine assembly 10. The present invention can be implemented and utilized in connection with many other configurations. Therefore, it should be understood that turbine assembly 10 is an exemplary assembly in which the present invention can be implemented and utilized.

Airfoil 18 extends outwardly into the working medium flow path of the turbine where working medium gases exert motive forces on the surfaces thereof. Airfoil 18 includes a pressure sidewall 22 and an opposite suction sidewall 24 (FIG. 2) joined together at a leading edge 26 (FIG. 1) and a trailing edge 28. Outer tip portion 20 comprises an outer tip cap 30, as shown in FIG. 2.

As best shown in FIG. 1, outer shroud 14 is spaced apart from tip section 20 so as to define a clearance gap 32 therebetween. As generally discussed in the above background section, the performance and efficiency of the turbine is critically affected by clearance gap 32. The greater the amount of leakage flow through clearance gap 32, the greater the inefficiency of the turbine, as the leakage flow is not exerting motive forces on the blade surfaces and accordingly is not providing work.

Figure 2:
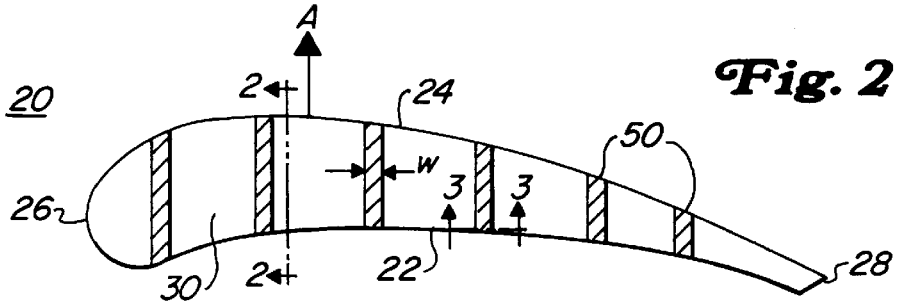
FIG. 2 is a top planar view of the tip section taken along section 1—1 of FIG. 1 in accordance with one embodiment of the instant invention.

In accordance with the instant invention, FIG. 2 shows tip section 20 that is defined by pressure sidewall 22, suction sidewall 24, leading edge 26, trailing edge 28, and tip cap 30. The direction of rotation of blade portion 12 (FIG. 1) is represented generally by arrow "A" of FIG. 2. A plurality of flow discouragers 50 are disposed on tip cap 30. Flow discouragers 50 protrude into clearance gap 32 so as to discourage and divert leakage flow between tip section 20 and outer shroud 14 by creating flow resistance therebetween.

Flow discouragers 50 enhance the flow resistance through clearance gap 32 (FIG. 1) and thus reduce the flow of hot gas flow leakage for a given pressure differential so as to improve overall turbine efficiency. In one embodiment, flow discouragers 50 extend circumferentially from pressure sidewall 22 to suction sidewall so as to be aligned generally parallel to the direction of rotation "A" of blade portion 12 (FIG. 1). The width (w) of flow discouragers may be varied for best performance, typically depending upon the size of the overall turbine assembly. In one embodiment, width (w) is in the range between about 0.003 inch (0.0076 cm) to about 0.10 inch (0.65 cm). In this embodiment, because flow discouragers 50 are disposed in the general direction of rotation, the probability of flow discourager survival in a tip rub is greatly enhanced. Additionally, because of the minimal weight addition due to flow discourgers 50, increased stress on rotor blade 12 is minimized.

Figure 3:
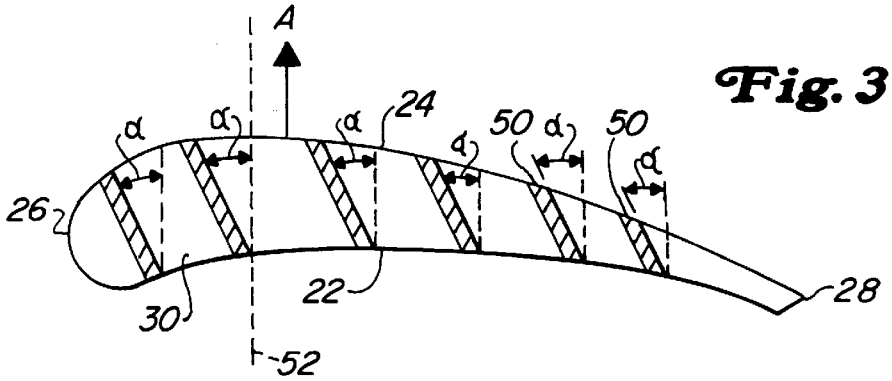
FIG. 3 is a view similar to that of FIG. 2 of another embodiment of the instant invention.

In accordance with another embodiment of the instant invention, FIG. 3 depicts flow discouragers 50 disposed on tip cap 30 at an angle ($\alpha$). Flow discouragers extend circumferentially from pressure sidewall 22 to suction sidewall 24 and are aligned at angle ($\alpha$) in the range between about 0° to about 60°, with respect to a reference axis 52 aligned generally parallel to the direction of rotation "A" of rotor blade 12.

Figure 4:
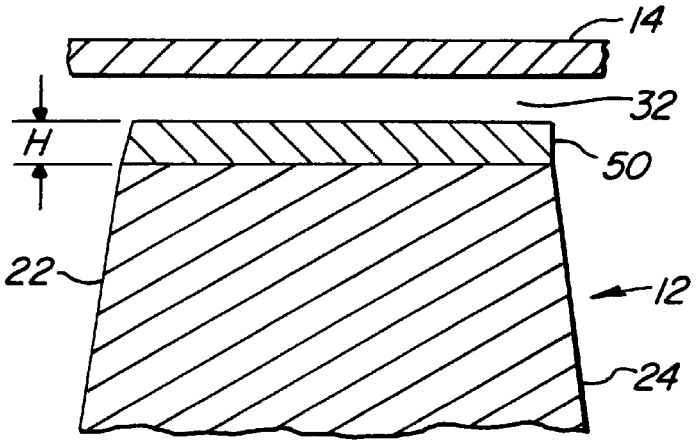
FIG. 4 is a partial cutaway view of a turbine blade taken along section 2—2 of FIG. 2 in accordance with the instant invention.

In accordance with one embodiment of the instant invention, FIG. 4 depicts a respective flow discourager 50 disposed on tip portion 20 (FIG. 1) of blade 12 (FIG. 4). The height (h) of flow discouragers 50 may be varied for best performance, typically depending upon the size of the overall turbine assembly. In one embodiment, height (h) is in the range between about 0.003 inch (0.0076 cm) to about 0.10 inch (0.065 cm). In another embodiment, the height (h) of flow discouragers 50 is about equal to the width (w) (FIG. 2) of flow discouragers 50.

Figure 5:
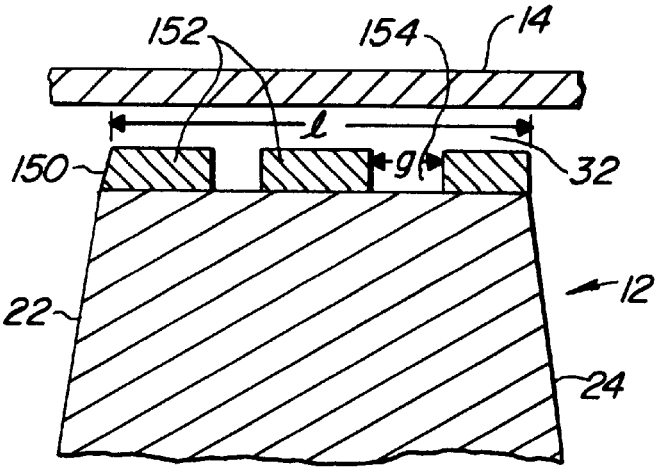
FIG. 5 is a partial cutaway view of a turbine blade taken along section 2—2 of FIG. 2 in accordance with another embodiment of the instant invention.

In accordance with another embodiment of the instant invention, FIG. 5 depicts a segmented flow discourager 150. Flow discourager 150 comprises at least two truncated discourager sections 152 that define at least one gap 154 therebetween. Gaps 154 comprise a width (g) that is typically in the range between about 0.1 to about 0.3 times the total length (l) of segmented flow discourager 150.

Figure 6:
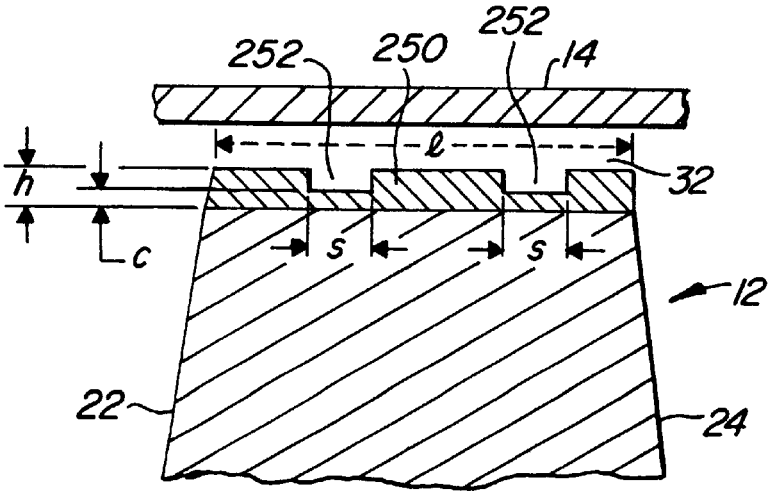
FIG. 6 is a partial cutaway view of a turbine blade taken along section 2—2 of FIG. 2 in accordance with another embodiment of the instant invention.

In accordance with another embodiment of the instant invention, FIG. 6 depicts a crown-shaped flow discourager 250. Crown-shaped flow discourager 250 comprises a multi-leveled flow discourager having at least two different heights (h) and (c) defining the crown-shaped cross section as indicated in FIG. 6. Height (h) is the upper level height and is typically in the range between about 0.003 inch to about 0.10 inch. Height (c) is the lower level height of cutout sections 252 and is typically in the range between about 0.001 inch to about 0.09 inch. Cutout sections 252 comprise a width (s) that is typically in the range between about 0.1 to about 0.3 times the total length (l) of crown-shaped flow discourager 250.

Each of the embodiments of the instant invention may further comprise rounded edges on respective flow discouragers as opposed to squared edges.

Figure 7:
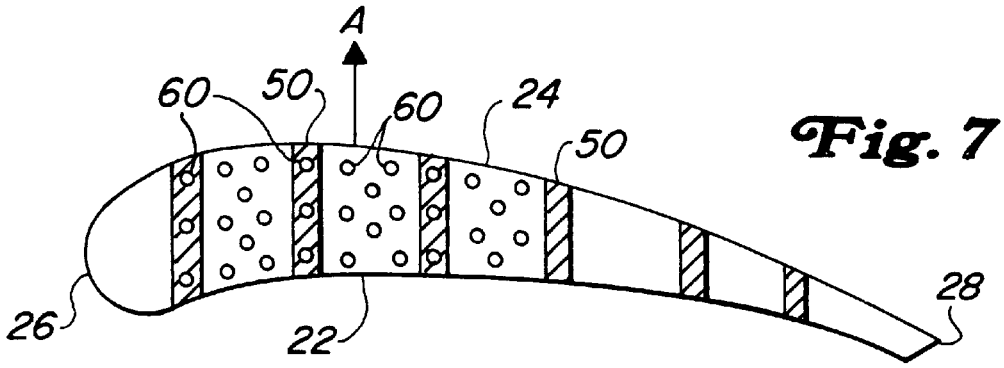
FIG. 7 is a top planar view of the tip section taken along section 1—1 of FIG. 2 in accordance with another embodiment of the instant invention.

Although the present invention is described herein in connection with flow discouragers, the present invention is not limited to the use of flow discouragers as the sole method of leakage flow prevention or tip cooling. In fact, the present invention can be implemented and utilized in many other configurations and combinations. For example, flow discouragers may be utilized in combination with tip cooling holes of various shapes and orientations. As shown in FIG. 7, an exemplary tip portion having flow discouragers 50 further comprises a plurality of interspersed tip cooling holes 60. Tip cooling holes 60 can be orientated so as to inject cooling air normal to the tip surface or, for example, may be angled to inject cooling air in some direction relative to the hot gas flow path.

In another embodiment, cooling holes are interspersed between adjacent flow discouragers 50. It is anticipated that this design will shield cooling holes 60 between adjacent flow discouragers 50, keeping the cooling air between adjacent discouragers and near to blade tip and providing some protection for cooling holes 60 during tip rubs, whereas conventional cooling holes may be closed off, after a tip rub. In another embodiment, cooling holes 60 are disposed within flow discouragers 50.

Figure 8:
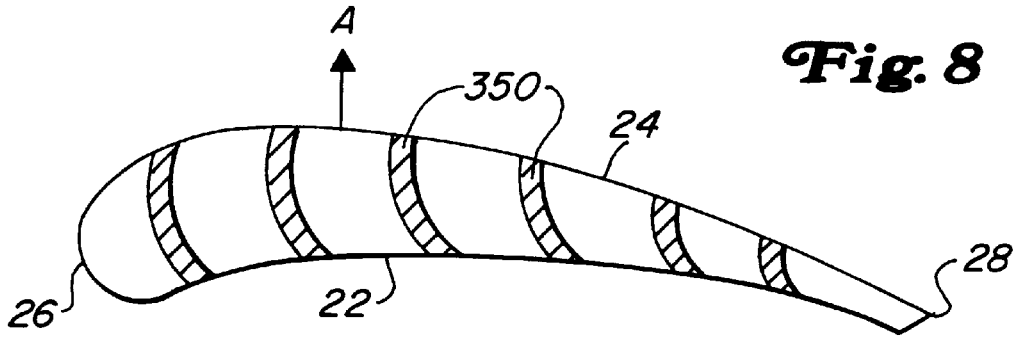
FIG. 8 is a top planar view of the tip section taken along section 1—1 of FIG. 1 in accordance with another embodiment of the instant invention.

In another embodiment of the instant invention, FIG. 8 depicts a plurality of arcuate flow discouragers 350 disposed on a tip cap 30. Arcuate flow discouragers 350 comprise a convex side and a concave side, which convex side is oriented towards either the pressure side or the suction side of the tip.

Figure 9:
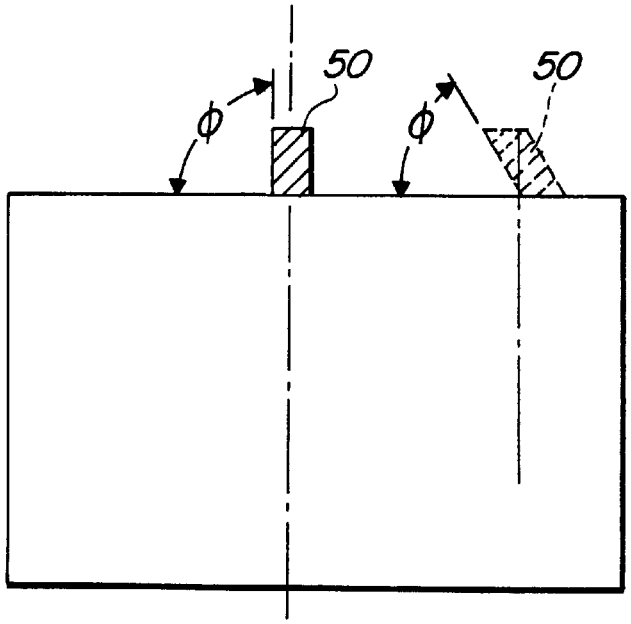
FIG. 9 is a partial cutaway view of a turbine blade taken along section 3—3 of FIG. 2 in accordance with another embodiment of the instant invention.

In accordance with another embodiment of the instant invention FIG. 9 depicts a partial cutaway view across section 3—3 of FIG. 2. As shown, the pitch (ϕ) of respective flow discouragers can be varied for best performance. In one embodiment, the pitch (ϕ) of flow discouragers is in the range between about 0° to about 60° with respect to a reference line 62 extending normal from tip cap 30. It is anticipated this design will create even greater flow restriction through clearance gaps 32 (FIG. 1).

Current manufacturing methods for high performance blades include welding and brazing of blade tips onto cast blades. Other blade designs may simply cast or machine blade shapes complete with tips, and then provide straight through coolant channels from root to tip, or no cooling at all.

The present invention can be employed with any suitable manufacturing method. The flow discouragers themselves may be formed, for example, by integral casting with the blade tip or complete blade, by electron-beam welding of flow discouragers to a blade tip, by physical vapor deposition of material to a blade tip, or by brazing material. Alternately, a blade tip which has been cast to oversized dimensions may have material removed by various methods, for example laser ablation, thereby forming flow discouragers.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A turbine assembly comprising:

a plurality of rotor blades comprising a root portion, an airfoil having a pressure sidewall and a suction sidewall, and a top portion having a tip cap;

an outer shroud concentrically disposed about said rotor blades, said shroud in combination with said tip portions defining a clearance gap therebetween; and a plurality of discrete flow discouragers disposed on said tip cap of said tip portion, wherein said flow discouragers extend circumferentially from said pressure sidewall to said suction sidewall so as to reduce hot gas flow leakage through said clearance gap wherein adjacent flow discouragers trap pockets of flow therebetween.

2. A turbine assembly in accordance with claim 1, wherein said flow discouragers are aligned generally parallel to the direction of rotation of said rotor blades.

3. A turbine assembly in accordance with claim 1, wherein said flow discouragers are aligned at an angle (α) with respect to a reference axis aligned generally parallel to the direction of rotation of said rotor blades.

4. A turbine assembly in accordance with claim 3, wherein said angle (α) is in the range between about 0° to about 60°.

5. A turbine assembly in accordance with claim 1, wherein the width (w) of said flow discouragers is in the range between about 0.003 inch to about 0.10 inch.

6. A turbine assembly in accordance with claim 1, wherein the height (h) of said flow discouragers is in the range between about 0.003 inch to about 0.10 inch.

7. A turbine assembly in accordance with claim 1, wherein the width (w) and the height (h) of said flow discouragers is about equal.

8. A turbine assembly in accordance with claim 1, wherein said flow discouragers comprise segmented flow discouragers having at least two truncated discourager sections that define at least one gap therebetween.

9. A turbine assembly in accordance with claim 8, wherein said at least one gap comprises a width (g) that is in the range between about 0.1 to about 0.3 times the total length (l) of said segmented flow discourager.

10. A turbine assembly in accordance with claim 1, wherein said flow discouragers comprise a crown-shaped flow discourager having at least two different heights (h) and (c) that defines the crown-shaped cross-section.

11. A turbine assembly in accordance with claim 10, wherein a first height (h) is in the range between about 0.003 inches to about 0.10 inches.

12. A turbine assembly in accordance with claim 10, wherein a second height (c) is in the range between about 0.001 inches to about 0.09 inches.

13. A turbine assembly in accordance with claim 1, further comprising a plurality of tip cooling holes.

14. A turbine assembly in accordance with claim 1, wherein said flow discouragers are arcuate in shape.

15. A turbine assembly in accordance with claim 1, wherein the pitch (ϕ) of said flow discouragers varies in the range between about 0° to about 60°.

* * * * *